United States Patent [19]

Johnson

[11] 4,027,199

[45] May 31, 1977

[54] FLASH LAMP MODULATOR SYSTEM

[75] Inventor: Richard C. Johnson, Pasedena, Calif.

[73] Assignee: Xerox Corporation, Stamford, Conn.

[22] Filed: June 11, 1975

[21] Appl. No.: 585,947

[52] U.S. Cl. ..... 315/241 R; 315/225; 315/239; 315/240; 320/1

[51] Int. Cl.[2] ..... H05B 41/32

[58] Field of Search ..... 315/241 P, 241 R, 227 R, 315/239, 240, 241 S, 225; 320/1

[56] References Cited

UNITED STATES PATENTS

| | | | |
|---|---|---|---|
| 3,154,732 | 10/1964 | Jensen | 315/241 P |
| 3,644,818 | 2/1972 | Paget | 315/241 P |
| 3,764,849 | 10/1973 | Ohta | 315/241 R |
| 3,780,344 | 12/1973 | Paget | 315/241 P |
| 3,819,983 | 6/1974 | Bjork | 315/238 |
| 3,822,393 | 7/1974 | Karpol | 315/241 R |
| 3,831,079 | 8/1974 | Iwata | 315/241 P |

*Primary Examiner*—Eugene La Roche

[57] ABSTRACT

An improved energy conversion apparatus for use in charging energy storage capacitors for energizing flash lamp devices. A transformer has a primary winding coupled to a low voltage DC source and transistor switches and a secondary winding coupled to a chargeable capacitor. The transistor switches are turned on or off in response to current signals in the primary and secondary windings. A detection circuit senses the energy stored in the capacitor and supplies signals to the transistor switches to maintain energy stored in the capacitor at a predetermined level.

4 Claims, 5 Drawing Figures

FLASH LAMP MODULATOR SYSTEM

This invention relates generally to a flash lamp modulator system and in particular to an improved energy conversion apparatus for maintaining a predetermined charge level on a capacitance of a flash lamp circuit used in a xerographic copier machine or the like.

In the xerographic process used for a plate, generally comprising a conductive backing upon which is placed a photoconductive insulating surface, is uniformly charged and the photoconductive surface then exposed to a light image of an original to be reproduced. The photoconductive surface is caused to become conductive under the influence of the light image so as to selectively dissipate the electrostatic charge found thereon to produce what is developed by means of a variety of pigmented resin materials specifically made for this purpose which are known in the xerographic art as "toners". The toner material is electrostatically attracted to the latent image areas on the plate in proportion to the charge concentration found thereon. Areas of high charge concentration become areas of high toner density while correspondingly low charge image areas become proportionally less dense. The developed image is transferred to a final support material, typically paper, and fixed thereto to form a permanent record or copy of the original.

Many forms of image fixing techniques are known in the prior art, the most prevalent of which are vapor fixing, heat fixing, pressure fixing or combinations thereof as described in U.S. Pat. No. 3,539,161. Each of these techniques, by itself or in combination suffer from deficiencies which make their use impractical or difficult for specific xerographic applications. In general, it has been difficult to construct an entirely satisfactory heat fuser having a short warm up time, high efficiency, and ease of control. A further problem associated with heat fusers has been their tendency to burn or scorch the support material. Pressure fixing methods whether hot or cold have created problems with image offsetting, resolution, degradation and producing consistently a good class of fix. On the other hand, vapor fixing, which typically employs a toxic solvent has proven commercially unfeasible because of the health hazard involved. Equipment to sufficiently isolate the fuser from the surrounding ambient air must by its very nature be complex and costly.

With the advent of new materials and new xerographic processing techniques, it is now feasible to construct automatic xerographic reproducing apparatus capable of producing copies at an extremely rapid rate. Radiant flash fusing is one practical method of image fixing that will lend itself readily to use in a high speed automatic processor as described in U.S. Pat. No. 3,529,129. The main advantage of the flash fuser over the other known methods is that the energy, which is propagated in the form of electromagnetic waves, is instantaneously available and requires no intervening medium for its propagation. As can be seen, such apparatus does not require long warm up periods nor does the energy have to be transferred through a relatively slow conductive or convective heat transfer mechanism.

Although an extremely rapid transfer of energy between the source and the receiving body is afforded by the flash fusing process, a major problem with flash fusing as applied to the xerographic fixing art, has been designing apparatus which can operate at one power level adequate to fuse all possible copy prints under varying conditions. This has led to several problems including a vast over consumption of power and poor negative latitude.

With the present invention an improved energy conversion apparatus is provided to control the power supply of flash lamps.

It is therefore the primary object of this invention to improve flash lamp modulator systems.

It is an object of this invention to improve flash fusing of xerographic toner images onto support material.

Another object of the invention is to improve flash lamp energization at a reduced power consumption.

Another object of the invention is to enable highly efficient fusing of toner images onto flexible support material.

For a better understanding of the invention as well as other objects and further features thereof, reference is had to the following description of the invention to be read in conjunction with the drawings wherein.

Figure 1:
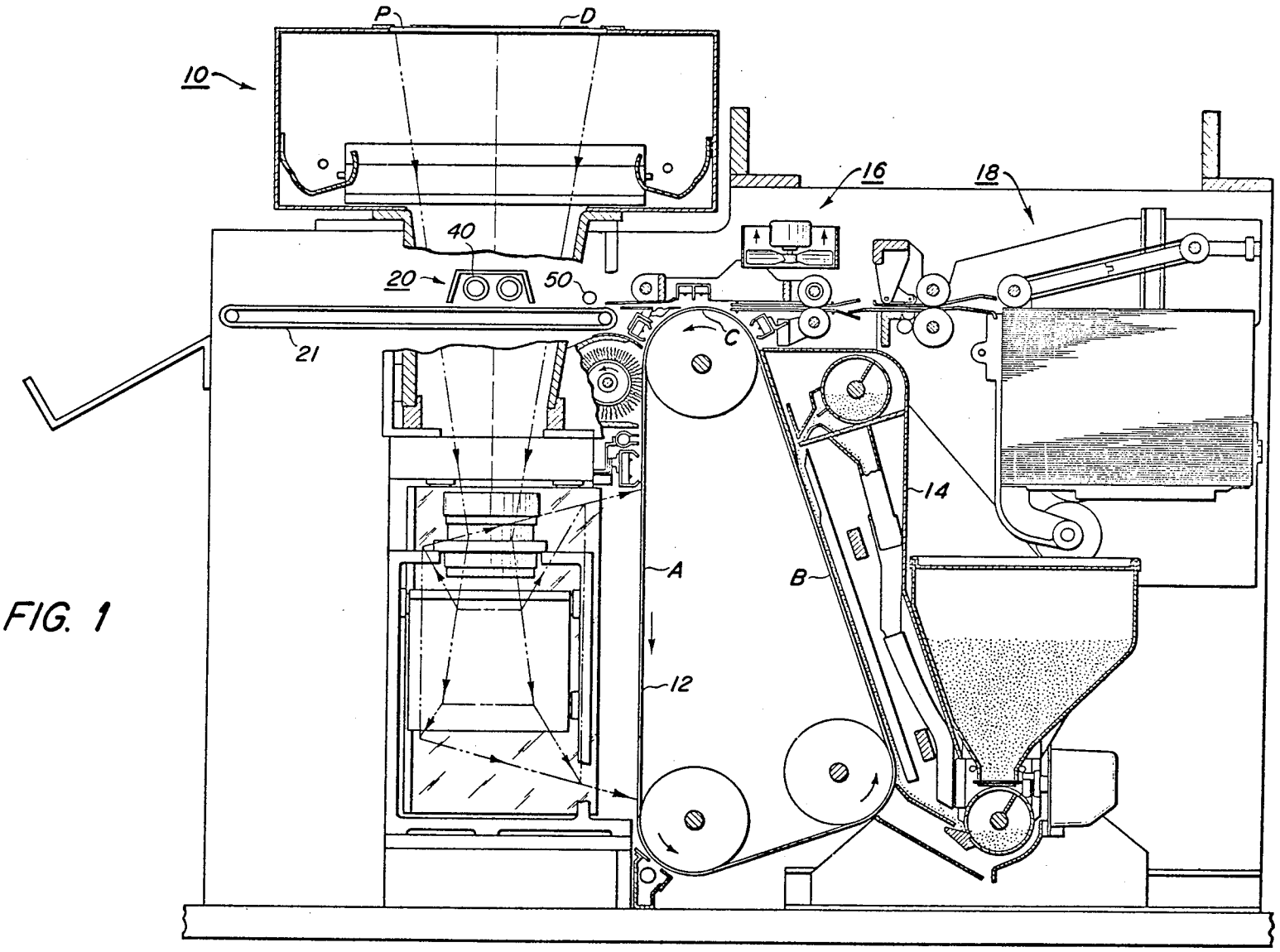
FIG. 1 illustrates xerographic reproducing apparatus incorporating a flash lamp modulator system in accordance with the present invention.

For a general understanding of the illustrated copier/reproduction machine, in which the invention may be incorporated, reference is had to FIG. 1 in which the various system components for the machine are schematically illustrated. As in all electrostatic systems such as a xerographic machine of the type illustrated, a light image of a document to be reproduced is projeced onto the sensitized surface of a xerographic plate to form an electrostatic latent image thereon. Thereafter, the latent image is developed with an oppositely charged developing material to form a xerographic powder image, corresponding to the latent image on the plate surface. The powder image is then electrostatically transferred to a support surface to which it is fused in this case by an improved flash fusing system whereby the powder images are caused permanently to be affixed to the support surface as will be described more fully hereinafter.

In the illustrated machine, an original D to be copied is placed upon a transparent support platen P fixedly arranged in an illumination assembly generally indicated by the reference numeral 10, arranged at the left end of the machine. The image rays are projected by means of an optical system for exposing the photosensitive surface of a xerographic plate in the form of a flexible photoconductive belt 12 which can be any suitable xerographic material such as selenium on an insulating surface.

The photoconductive belt 12 is mounted upon the frame of the machine and is adapted to move in the direction of the arrow at a constant rate. During this movement of the belt, the light image of the original on the platen is flashed upon the xerographic surface of the belt. The flash exposure of the belt surface to the light image discharges the photoconductive layer in the areas struck by light, whereby there remains on the belt a latent electrostatic image in image configuration corresponding to the light image projected from the original on the supporting platen. As the belt surface continues its movement, the electrostatic image passes through a developing station B in which there is positioned a developed assembly generally indicated by the reference numeral 14. The developer assembly 14 deposits developing material to the upper part of the belt where the material is directed to cascade down over the upwardly moving inclined belt in order to provide development of the electrostatic image. As the developing material is cascaded over the xerographic plate, toner particles in the development material are deposited on the belt surface to form powder images.

The developed electrostatic image is transported by the belt to a transfer station C where a sheet of copy paper is moved at a speed in synchronism with the moving belt in order to accomplish transfer of the developed image. There is provided at this station a sheet transport mechanism generally indicated at 16 adapted to transport sheets of paper from a paper handling mechanism gerally indicated by the reference numeral 18 to the developed image on the belt at the station C.

After the sheet is stripped from the belt 12, it is conveyed to an improved flash fuser system generally indicated by the reference numeral 20 where the developed and transferred xerographic powder image on the sheet material is permanently affixed thereto according to the present invention as will be explained hereinafter. After fusing, the finished copy is discharged from the apparatus by a belt conveyor 21 to a suitable point for collection externally of the apparatus.

Suitable drive means may be arranged to drive the belt 12 in conjunction with timed flash exposure of an original to be copied, to effect conveying and cascade of toner material, to separate and feed sheets of paper and to transport the same across the transfer station C and to convey the sheet of paper through a flash fuser in timed sequence to produced copies of the original.

It is believed that the foregoing description is sufficient for the purpose of this application to show the general operation of an electrostatic copier usng a flash lamp modulator system constructed in accordance with the invention. For further details concerning the specific construction of the electrostatic copier, reference is made to U.S. Pat. No. 3,661,452 issued on May 9, 1972 in the name of Hewes et al.

Figure 2:
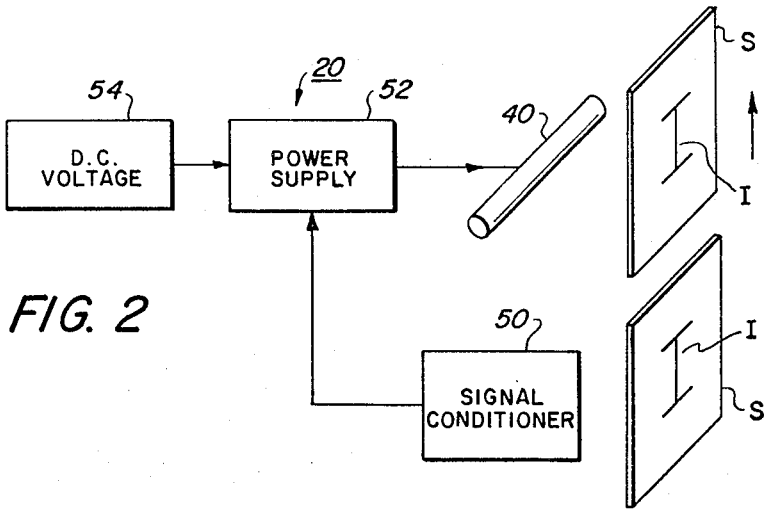
FIG. 2 is a block diagram of the flash fusing system.

As best depicted in the block diagram of FIG. 2, the mass of toner images I on individual copy sheets S is sensed via its reflectivity and a input produced by sensor and signal conditioner 50 is made to an energy storage power supply 52 which supplies an input to one or more flash lamps 40 of the system 20 to produce the desired power level at optimum energy for flashing the lamps. Power supply 52 recives another input from D.C. voltage sources 54.

Figure 3:
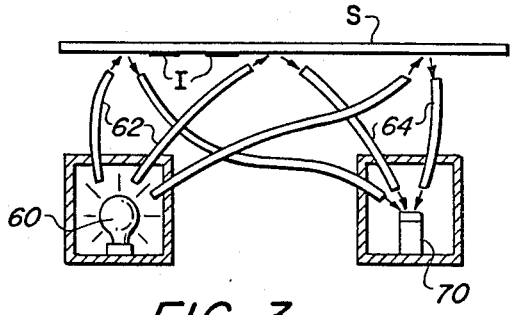
FIG. 3 is a schematic view of the copy reflectivity sensing apparatus.

Referring now to FIG. 3 there is shown the sensing apparatus for sensing the density of toner on a copy sheet to be fused and producing spatially concentrated optical signals and converting the optical signals into electrical signals proportional thereto for input as will be discussed more fully hereinafter. As the lead edge of the copy sheet S bearing loose toner images I comes into view of the sensing apparatus light originating from a light source 60 is conducted towards the copy sheet S via an array of fiber optic elements 62 such that a uniform line source of illumination is provided across the sheet S. A second array of fiber optic elements 64 receives the reflected illumination which is transmitted to a localized area 65 and coupled into a photosensor 70.

Figure 4:
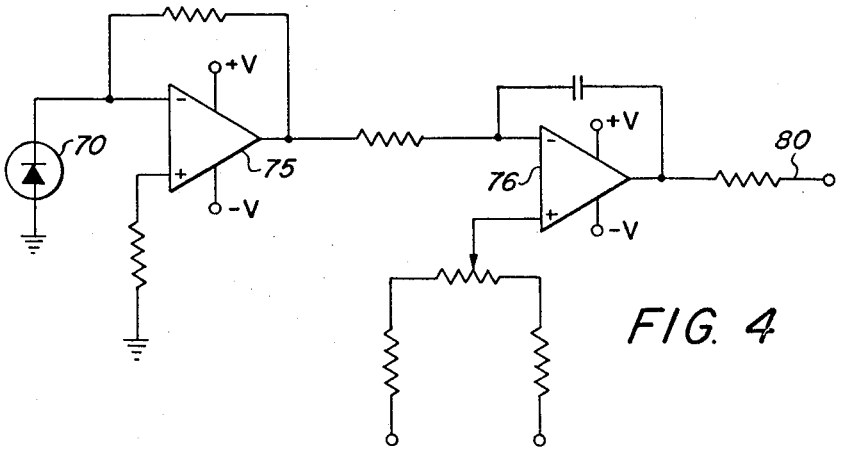
FIG. 4 is a circuit for the sensor and signal conditioner shown by a block in FIG. 2.

Shown in FIG. 4 is a circuit for the signal sensor and signal conditioner 50. Photosensor 70 is a photodiode whose current is proportional to the incident illumination. The output of photosensor 70 is amplified by amplifier 75 and integrated by integrator 76 providing an output voltage 80 for controlling the output of the energy storage power supply 52. It should be understood that the output voltage 80 from integrator 76 must be reset after each copy sheet S is fused by any suitable circuit.

Figure 5:
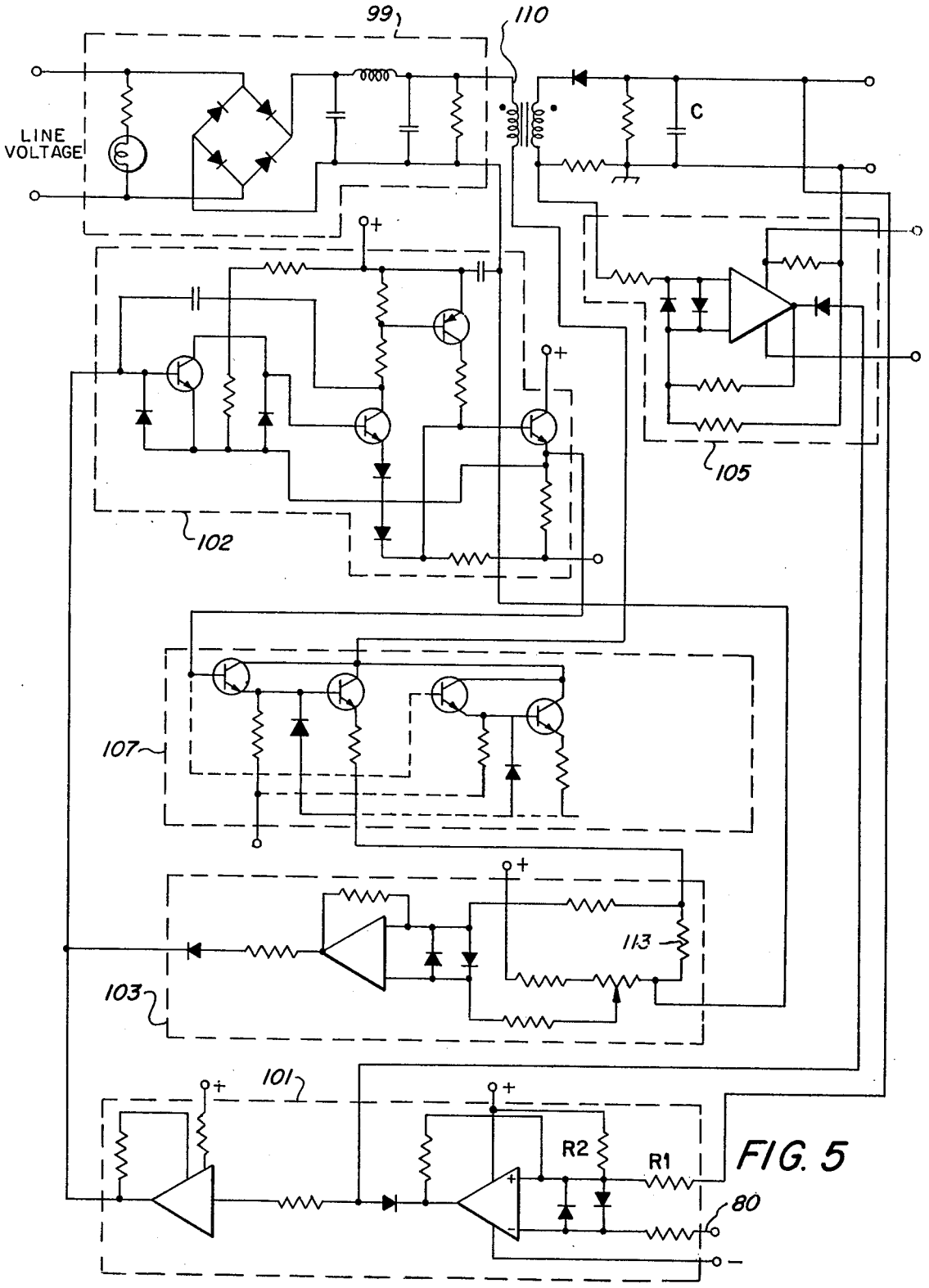
FIG. 5 is a circuit for the energy storage power supply shown by a block in FIG. 2.

The operation of the system can be best understood by referring to the diagramatic circuit shown in FIG. 5. A rectifier filter 99 inverts AC line voltage to a DC voltage. The output 80 from sensor and conditioner 50 is fed into voltage sensor 101 which includes a comparator 111 and a bufer 112 which together inhibit transistor switch driver 102 which serves as a preamplifier and conditioner for switches 107. The transistor switch driver 102 is also inhibited by an input from the minimum current sensor 105. Sensor 105 includes amplifier 115 which senses voltage and hence charging current across resistor 116 which includes a current sensing resistor 113 coupled to a comparator amplifier 114. A peak current sensor 103 provides base drive to switch driver 102 and indirectly to transistor switches 107. Switches 107 which include one or more Darlington switches with adequate protection and current balancing switch current through the primary winding of transformer 110. By virtue of the diode 118 in series with the secondary winding of transformer 110, the phasing of primary with respect to the secondary is such that when the primary is conducting the secondary is not conducting and vice versa. The energy from the primary winding is coupled to the secondary winding when said switch is turned off. The secondary energy is rectified and stored in capacitor C. Discharging the capacitor which reduces the load impedance of the secondary to virtually zero allows the primary to conduct in the normal manner since the primary is not coupled to the secondary load when said switch is on. The voltage of capacitor C is sensed by and divided down by resistors R1 and R2 and inputed into voltage sensor 101. The energy stored on capacitor C is delivered as the input voltage to flash lamps 40 for fusing the image I on the copy sheets S. This input voltage supplied to the flash fusing lamps 40 results in optimum energy to fuse the toner images onto the copy sheets.

The functional elements that complete the circuit of FIG. 5 comprise a rectifier filter 99, transformer switch 110 with one diode 118 in series with the secondary, power transistor switch 107, a driver 102, voltage sensor circuit 101, peak current sensor circuit 103, and minimum current sensor circuit 105. Arrangement of the driver 102 and the three sensor circuits is such that when AC power is applied to the rectifier filter 99 and low voltage power supply, sequential switching of the transformer 110 begins. Switching stops when the exact predetermined value of energy is in the storage capacitor C.

One unique feature of this invention is that the primary and secondary of transformer 110 conduct alternately so that when the storage capacitor C is discharged into the lamp, which is a low impedance, or during initial charging of the storage capacitor, the primary circuit is never stressed by excessive current.

When line voltage is applied to the rectifier filter 99 and low voltage supply, a DC voltage is available for the circuit including plus and minus terminals which are about 10 volts for the sensor circuits and driver 102. Driver 102 also includes a plus of about 6 volts at one terminal. Biasing of the four transistors in the driver is such as to cause current to flow into the bases of the parallel transistors comprising the switch 107. This drive current turns on switch 107 and current flows from the plus of rectifier filter through the primary of transformer 110, switch 107 and current sensing resistor 113, back to the minus of the rectifier filter. The current increases linearly with respect to time, and the small voltage drop across current sensing resistor 113 increases proportionately. The voltage drop is compared to a reference voltage by means of the IC voltage comparator of peak current sensor 103. The reference voltage is derived from a resistance voltage divider which consists of a fixed resistor and a potentiometer across the volts terminal.

Diodes across the input of the IC voltage comparator protect the IC from transients which could cause failure of the IC. A portion of the output from the comparator is feedback to the non-inverting input means of a resistor. This positive feedback results in extremely high gain of the comparator when the voltage drop across current sensing resistor 113 reaches a value large enough to cause the output of the IC comparator to swing positive. Positive feedback also provides hysteresis so that the output of the comparator will stay positive even though the current through the sensing resistor 113 decreases.

Output of the comparator is coupled to the base of a transistor in the driver 102 by means of a diode and resistor. A positive signal drives current into the base of this transistor which in turn biases the other three transistors off. When these transistors are turned off, current from the driver 102 to the switch 107 is zero. Switch 107 is turned off and current through the primary transformer 110 decreases to zero in a relatively very short time. Positive feedback in the comparator causes the fast switching.

When current in the primary is switched from a high value of current to zero, voltage polarity reverses so that current instantly flows in the secondary. The instantaneous peak current in the secondary is equal to the peak primary current times the inverse of the turns ratio for the transformer 110.

Current in the secondary flows from the low side through the current sensor resistor 116 into capacitor C back to the high side through the blocking diode. Since the secondary winding is an inductor charged with a value of current, the very nature of an inductor generates the necessary voltage to keep the current flowing. Thus, as the storage capacitor C is charged and increases in voltage, the secondary will always produce sufficient voltage to driver current into the capacitor.

Current in the secondary circuit of inductor transformer starts with a large value and decreases to zero. Voltage across resistor 116 caused by the secondary current is proportional to the decreasing current, and is compared to a reference voltage by an IC voltage comparator located in the secondary current sensor 105. Output of the comparator is coupled to buffer 112 located in the voltage sensor 101. Output of buffer 112 is directly connected to the input of driver 102. Thus, when current is flowing in the secondary winding, the buffer 112 provides a signal to keep driver 102 and switch 107 off. When the secondary current decreases to a low value, the signal from the secondary current sensor 105 changes to that the driver 102 and switch 107 are allowed to turn on. Primary current then begins increasing and the cycle repeats.

The time that secondary current flows is related to the basic equation:

$$E = L\ (\Delta i/\Delta t)\ \Delta t = (L\Delta i/E)$$

where $L$ = secondary inductance of 110

$\Delta i$ = change in secondary current $E$ = voltage of storage capacitor C $\Delta t$ = time secondary current conducts.

Since $L$ and $\Delta i$ are constants and the value of $E$ changes during the charging time of capacitor C, $\Delta t$ varies with respect to $E$. Typical values are:

$L$ = 1.2 henries $\Delta i$ = 1.8 amp $E$ = varies from 0 to 5000 volts $\Delta t$ = varies from 400 microseconds to 20 milliseconds.

The voltage of capacitor C is divided by resistor R1 and R2 in voltage sensor 101. The voltage across R2 is compared to reference voltage at 80 by means of an IC voltage comparator. The output of comparator is coupled to buffer 112 by means of a diode. A signal into buffer 112 from the comparator turns off driver 102 and switch 107. As long as the voltage of capacitor C remains at a predetermined value the switch 107 will remain off. Should the predetermined value increase as the result of a signal from the area sensor 50 the switching cycle will begin. Voltage of capacitor C will increase to the proper value, then the converter will be switched off.

Above is described a new and improved flash lamp modulator system which is an improvement over conventional flash exposure systems. It will be appreciated that the system of the invention requires no quenching tube to terminate the flash. With the present invention a control of energizing flash lamps is provided requiring simpler and much less sophisticated circuitry and a greater inherent reliability.

While the invention has been described with reference to the structure disclosed herein it is not confined to the details set forth in this application but is intended to cover such modifications or changes as may come with the purpose of the improvements or the scope of the following claims:

What is claimed is:

1. An improved energy conversion apparatus comprising:

transformer means having a primary winding coupled to a low voltage DC source and switching means, said transformer means having a secondary winding coupled to chargeable capacitor means, said switching means being turned on or off in response to electrical signals in the primary and secondary windings, and detection means for sensing the energy stored in said capacitor means and supplying signals to said switching means to maintain energy stored in said capacitor means at a predetermined level, wherein said primary and secondary windings of said transformer means are phased so that when said primary winding is conducting said secondary winding is not conducting and vice versa.

2. An improved energy conversion apparatus according to claim 1 wherein a short circuit arising in said secondary winding is not operative to cause damage to said switching means.

3. An improved energy conversion apparatus comprising:

transformer means having a primary winding coupled to a low voltage DC source and unidirectional switching means, said transformer means having a secondary winding coupled to chargeable capacitor means, said unidirectional switching means being turned on or off in response to electrical signals in the primary and secondary windings, and detection means for sensing the energy stored in said capacitor means and supplying signals to said unidirectional switching means to maintain energy stored in said capacitor means at a predetermined level by turning said switching means on and off, said detection means includes a current sensing resistor coupled to a comparator amplifier.

4. Apparatus according to claim 3 wherein said detection means further includes voltage sensing resistor means for detecting the voltage across said capacitor means.

* * * * *